United States Patent [19]

Sirch et al.

[11] 4,165,756

[45] Aug. 28, 1979

[54] WASHING TUNNEL FOR CLEANING GLASS CONTAINERS

[75] Inventors: Edgar Sirch; Johann Franz, both of Leverkusen; Dirk-Torsten Kruger, Bergisch-Gladbach; Anton Spenner, Leverkusen; Paul-Günter Underberg, Bergisch-Gladbach, all of Fed. Rep. of Germany

[73] Assignee: Bayer Aktiengesellschaft, Leverkusen, Fed. Rep. of Germany

[21] Appl. No.: 931,080

[22] Filed: Aug. 4, 1978

[30] Foreign Application Priority Data

Aug. 6, 1977 [DE] Fed. Rep. of Germany ..... 2735532

[51] Int. Cl.[2] ..... B08B 3/02; B08B 9/08

[52] U.S. Cl. ..... 134/56 R; 134/63; 134/126; 134/131; 134/133; 134/152

[58] Field of Search ..... 134/43, 56 R, 62–63, 134/72, 113, 126–127, 131, 133, 152

[56] References Cited

U.S. PATENT DOCUMENTS

| | | | |
|---|---|---|---|
| 2,249,614 | 7/1941 | Ladewig | 134/126 X |
| 2,617,435 | 11/1952 | Kessler | 134/131 X |
| 2,655,928 | 10/1953 | Herold | 134/126 X |
| 3,064,663 | 11/1962 | Sariotti et al. | 134/133 X |

FOREIGN PATENT DOCUMENTS

| | | | |
|---|---|---|---|
| 412606 | 4/1966 | Switzerland | 134/133 |

*Primary Examiner*—Robert L. Bleutge

*Attorney, Agent, or Firm*—Sprung, Felfe, Horn, Lynch & Kramer

[57] ABSTRACT

A longitudinal automatic sprayer for cleaning glass containers based on two parallel conveyor chains on which transverse beams carrying individual baskets are arranged perpendicularly to the direction of transport. At the beginning of the conveyor, the individual baskets are automatically filled with the unclean glass containers by a transfer device. A delivery device for automatically ejecting the containers is situated at the end of the conveyor. Spray nozzles for rinsing the glass containers are arranged above the conveyor. The individual baskets are checked for breakage by a mechanical scanning device underneath the conveyor chains. At the same time, the scanning device monitors the positioning of the individual baskets appropriate to the working cycle.

4 Claims, 3 Drawing Figures

WASHING TUNNEL FOR CLEANING GLASS CONTAINERS

The invention is based on a longitudinal automatic sprayer for cleaning glass containers for parenteral medicaments. This elongated automatic sprayer basically comprises two parallel endless chains for transporting a row of transverse beams arranged perpendicularly to the direction of transport, on which beams are situated baskets for receiving the objects which are to be cleaned, a transfer device for the containers at the beginning of the machine and a delivery device at the end of the machine, and rows of spray nozzles also arranged perpendicularly to the conveyor chains for cleaning or "blowing out" the glass containers.

Automatic washing systems of this type are already known and available commercially and therefore only their mode of operation will briefly be described here. The containers which are required to be cleaned, inter alia glass bottles, are transferred in rows into the individual baskets arranged in rows on the transverse beams by the transfer device. The number of these beams varies according to the type of machine (e.g. 25 to 40). The machine operates in cyles. During a stand-still period, the bottles inside the baskets are washed by spray nozzles arranged above and/or below them, from which water is sprayed into and over the bottles. The bottles are discharged by the pivoting of the beams at the end of the conveyor belt.

In the pharmaceutical industry, glass bottles are sterilized at high temperatures after they have been washed. The sterilization tunnels required for this operation usually immediately follow the longitudinal automatic sprayer.

Although the probability of glass breakage occurring during the washing process is slight, it has been found that when such breakage does occur, fragments of glass are liable to get caught in the baskets. Although a basket containing such fragments will be refilled with a glass bottle at the inlet of the machine, adequate cleaning of the inside of this bottle can no longer be ensured because the basket opening is liable to be covered by the glass fragments. There is the added risk that such bottles may still contain substantial residues of water as they enter the sterilization tunnel, with the result that they will not reach the necessary sterilization temperature, e.g. 300° C. Similar problems arise if a bottle gets jammed in the basket. Another source of malfunction is that the conveyor chains are liable to get pulled out of shape due to wear and tear so that the glass bottles may not be accurately positioned over the spray nozzles. In such a case, the glass bottles will not be sufficiently sprayed.

It is an object of the present invention to develop a longitudinal automatic sprayer which will ensure perfect washing of each individual bottle. In particular, jamming or breakage of bottles in their baskets and unallowable distortion of the conveyor chain should be recognized in good time.

In accordance with the invention there is provided a longitudinal automatic sprayer for cleaning glass containers for parenteral medicaments, comprising two parallel chains operating in cycles for conveying a row of transverse beams arranged perpendicularly to the direction of transport, said chains arranged to provide an upper and a lower conveyor run and said transverse beams, carrying individual baskets, each basket for receiving one glass container, a transfer device at the upstream end of the upper conveyor run and a delivery device for the containers at the downstream end of the upper conveyor run, and spray nozzles for spraying the glass containers, wherein a mechanical scanning device for checking the baskets for the presence of glass bodies is arranged below the lower conveyor run, which scanning device at the same time controls the exact positioning of the baskets appropriate to the operating cycle.

The scanning device preferably comprises shaped elements which can be moved into the baskets from below. The shape of these elements should conform to the shape of the baskets.

The reliability of the automatic washing system can be further increased by arranging an ejector device for broken glass or jammed bottles above the lower run of the conveyor chains, again transversely to their direction of transport.

An advantage of the invention is that broken glass or jammed bottles are reliably removed from the baskets before the baskets are re-charged, so that the risk of unsterile bottles entering pharmaceutical production can be further reduced. Another important advantage is that the scanning and ejector device used in the invention can easily be installed as an additional feature in an existing longitudinal automatic sprayer, in which case the expenditure on an apparatus is relatively low.

An example of the invention will be described below in more detail with reference to the accompanying drawings, in which.

Figure 1:
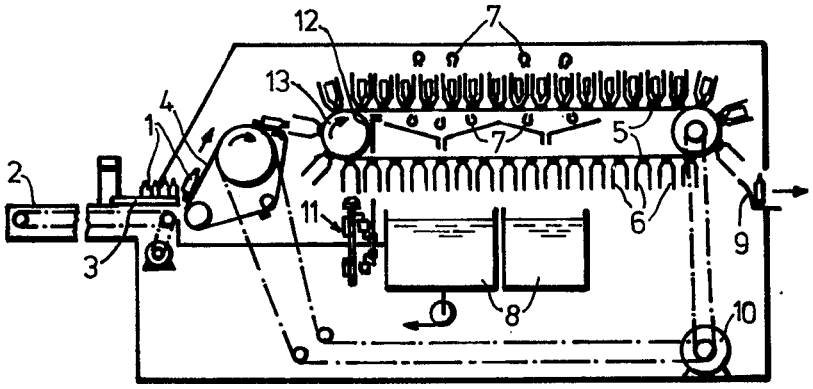
FIG. 1 is a schematic side view of a longitudinal automatic sprayer.

In the embodiment of the longitudinal automatic sprayer according to FIG. 1, the glass bottles are piled up on a table 2, sorted into rows in a sorting device 3 and then conveyed to a transfer device 4, an inclined elevator, which transfers them at its top end to baskets 6 which are fixed to a transverse beam 5. The baskets 6 in this case consist of a cylindrical container which tapers towards the bottom, where it has an opening. As the shape resembles that of a tulip, the baskets will hereinafter simply be referred to as "tulips". The tulips (e.g. 30 in number) are fixed in a row to the beams which are arranged perpendicularly to the direction of transport. The bottles 1 inside the tulips 6 are thus conveyed along the upper run of the conveyor chains by the transverse beams 5. Rows of spray nozzles 7 are arranged above and below the upper run, transversely to the direction of movement of the bottles. During a stand still period, hot water is sprayed into and over the bottles 1 at the various washing stations. Finally, dry air is blown at the bottles. The wash water collects in containers 8. A transfer device 9 for the bottles 1 is arranged at the end of the passage. It principally comprises a rail to which the bottles 1 are transferred in an upright position when the tulips are deflected at the end of the transport. The conveyor chains 15 and transfer device 4 have a common drive 10.

The stations for the treatment of the bottles 1 (washing, blowing with air and, if necessary, coating with silicone) are all arranged along the upper run. The lower run provides space for the control devices acting on the "empty" tulips 6. According to FIG. 1, a scanning device 11 and an ejector device 12 are arranged close to a deflecting roller 13 near the elevator at the beginning of the passage along which the bottles are conveyed.

Figure 2:
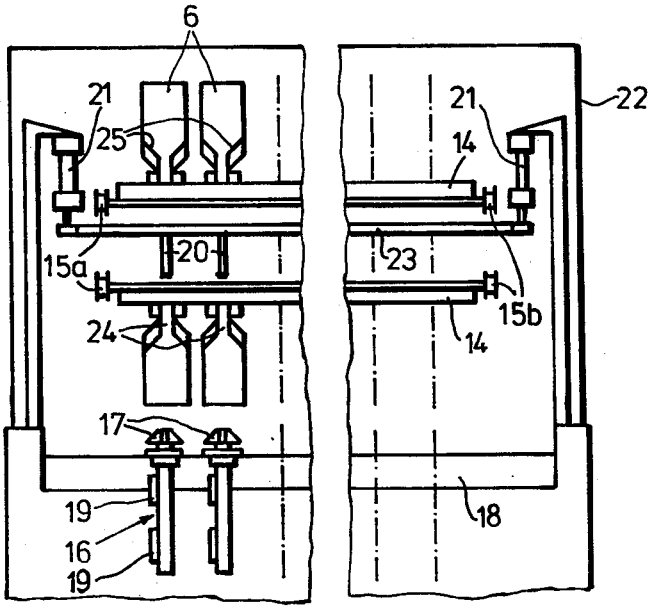
FIG. 2 is a view of the scanning and ejector device in the direction of transport and FIG. 3 represents the shaped elements of the scanning device in detail.

The structure of the scanning device 11 and ejector device 12 will now be described with reference to a front view (i.e., viewed in the direction of transport). FIG. 2 also shows the arrangement of the tulips 6 on a transverse beam 4. The transverse beam 5 is fixed to the two circulating endless chains 15*a* and 15*b*. The scanning device 11 is arranged underneath the lower run and comprises a plurality of mechanical scanning elements 16 which at standstill are in alignment with a row of tulips. The mechanical scanning elements comprise pneumatic cylinders which have shaped elements 17 at the piston ends. The cylinders are mounted in a frame 18 underneath the lower run of the conveyor belt. During a stand still period, the shaped elements 17 are moved into the empty tulips 6 from below by operation of the cylinders. If a tulip contains a glass body (fragment of jammed bottle) or if the conveyor chains 15*a*, 15*b* have become distorted, a shaped element 17 is unable to move into its end position. Capacitance switches 19 then respond. A control impulse is thereby produced, which switches off the machine. The glass bodies can then be removed from tne affected row of tulips. When all the tulips are empty, the elements 17 move out of the tulips and the next operating cycle is released.

The automatic ejector device 12 (see FIG. 1) is situated above the lower run of the conveyor belt. It comprises a plurality of rods 20 which are in alignment with the openings in a row of tulips and can be moved downwards by a pneumatic device comprising two air cylinders 21 mounted on side carriages 22 on the two sides of the conveyor belt. Their pistons are connected together by a bar 23 which extends parallel to the transverse beam 5. Rods 20 are fixed to the bar 23. A glass body contained within a tulip is ejected by the rods 20 being moved from above through appropriate openings in the transverse beam 5 and openings 24 in the tulips into the interior of the tulips 6 during a standstill period. This reliably removes any glass bodies left in the tulips 6. The ejector device may be selectively connected to this mechanism, but a logical coupling with the scanning device 11 for checking empty tulips is preferable.

Figure 3:
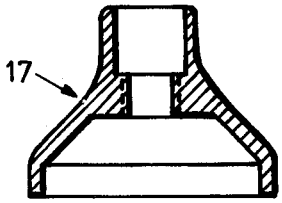

FIG. 3 represents a cross-section through the shaped elements 17 of the scanning device. The shape of the elements 17 conforms to the lower, conical end 25 of the tulips.

The accessory devices according to the invention ensure that (A) each tulip 6 is checked for complete emptying, (B) each tulip will in fact be emptied and (C) any distortion of the conveyor chains 15*a* and 15*b* will be reliably detected.

These control functions considerably contribute to an increase in the reliability of cleaning and sterilization of glass containers in the pharmaceutical industry.

What we claim is:

1. A longitudinal automatic sprayer for cleaning glass containers for parenteral medicaments, comprising two parallel chains operating in cycles for conveying a row of transverse beams arranged perpendicularly to the direction of transport, said chains arranged to provide an upper and a lower conveyor run and said transverse beams carrying individual baskets, each basket for receiving one glass container, a transfer device at the upstream end of the upper conveyor run and a delivery device for the containers at the downstream end of the upper conveyor run, and spray nozzles for spraying the glass containers, wherein a mechanical scanning device for checking the baskets for the presence of glass bodies is arranged below the lower conveyor run, which scanning device at the same time controls the exact positioning of the baskets appropriate to the operating cycle.

2. An apparatus according to claim 1, wherein the scanning device comprises shaped elements which are movable into the baskets from below and in that the shape of the shaped elements conforms to the shape of the baskets.

3. An apparatus according to claim 1, wherein an ejector device for ejecting whole glass bodies or fragments from the baskets is arranged above the lower conveyor run.

4. An apparatus according to claim 1, wherein the said baskets are in the form of receiver tulips having an opening in their base.

* * * * *